US006911889B2

(12) United States Patent
Bodley et al.

(10) Patent No.: US 6,911,889 B2
(45) Date of Patent: Jun. 28, 2005

(54) HIGH FREQUENCY FILTER DEVICE AND RELATED METHODS

(75) Inventors: Lesley Paige Bodley, Chattanooga, TN (US); James A. Smith, deceased, late of Soddy Daisy, TN (US); by Marjorie E. Smith, legal representative, Las Vegas, NV (US); Richard W. Meadors, Chattanooga, TN (US); Henry G. Paris, Chattanooga, TN (US)

(73) Assignee: Steward, Inc., Chattanooga, TN (US)

( * ) Notice: Subject to any disclaimer, the term of this patent is extended or adjusted under 35 U.S.C. 154(b) by 340 days.

(21) Appl. No.: 10/224,547

(22) Filed: Aug. 20, 2002

(65) Prior Publication Data

US 2004/0000967 A1 Jan. 1, 2004

Related U.S. Application Data

(60) Provisional application No. 60/313,639, filed on Aug. 20, 2001.

(51) Int. Cl.[7] ..... H01F 5/00

(52) U.S. Cl. ..... 336/200; 336/232; 336/223; 29/602.1

(58) Field of Search ..... 336/200, 223, 336/232; 29/602.1; 333/185, 182, 181

(56) References Cited

U.S. PATENT DOCUMENTS

| | | | | | |
|---|---|---|---|---|---|
| 3,659,231 | A | | 4/1972 | De Vries | 333/72 |
| 4,093,688 | A | | 6/1978 | Withop et al. | 264/65 |
| 4,155,863 | A | | 5/1979 | Simonet | 252/62.59 |
| 4,277,356 | A | | 7/1981 | Simonet | 252/62.59 |
| 4,758,808 | A | | 7/1988 | Sasaki et al. | 333/185 |
| 4,796,079 | A | | 1/1989 | Hettiger | 357/68 |
| 5,023,580 | A | | 6/1991 | Kim et al. | 333/206 |
| 5,302,932 | A | * | 4/1994 | Person et al. | 336/200 |
| 5,382,930 | A | | 1/1995 | Stokes et al. | 333/191 |
| 5,407,743 | A | | 4/1995 | Clough et al. | 428/357 |
| 5,448,211 | A | | 9/1995 | Mariani | 333/205 |
| 5,479,695 | A | * | 1/1996 | Grader et al. | 29/602.1 |
| 5,592,134 | A | * | 1/1997 | Ogata et al. | 333/185 |
| 5,756,207 | A | | 5/1998 | Clough et al. | 428/375 |
| 5,793,601 | A | * | 8/1998 | Nakamura et al. | 361/321.4 |
| 5,801,597 | A | | 9/1998 | Carter et al. | 333/12 |
| 5,821,846 | A | * | 10/1998 | Leigh et al. | 336/200 |
| 5,905,417 | A | | 5/1999 | Norte et al. | 333/185 |
| 5,914,644 | A | | 6/1999 | Carter et al. | 333/12 |
| 5,945,892 | A | | 8/1999 | Kato et al. | 333/185 |
| 6,133,809 | A | * | 10/2000 | Tomohiro et al. | 333/185 |
| 6,191,667 | B1 | | 2/2001 | Takenaka et al. | 333/185 |
| 6,483,400 | B1 | * | 11/2002 | Phillips, Jr. | 333/185 |
| 6,568,054 | B1 | * | 5/2003 | Kumagai et al. | 29/25.42 |
| 6,713,162 | B2 | * | 3/2004 | Takaya et al. | 428/209 |

* cited by examiner

*Primary Examiner*—Anh Mai
(74) *Attorney, Agent, or Firm*—Allen, Dyer, Doppelt, Milbrath & Gilchrist, P.A.

(57) ABSTRACT

A filter device may include a plurality of ferrite filters laminated together in vertically stacked relation, where each ferrite filter may include a pair of ferrite layers laminated together in vertically stacked relation and a lateral conductor extending therebetween. The filter device may also include at least one vertical conductor connecting the lateral conductors together in series. Moreover, at least some of the ferrite filters may have different operating characteristics. In particular, the different operating characteristics may be different impedance versus frequency characteristics to thereby broaden an attenuation frequency band of the filter device.

31 Claims, 4 Drawing Sheets

HIGH FREQUENCY FILTER DEVICE AND RELATED METHODS

CROSS-REFERENCE TO RELATED APPLICATIONS

This application claims the benefit of U.S. Provisional Application No. 60/313,639, filed Aug. 20, 2001, which is hereby incorporated herein in its entirety by reference.

FIELD OF THE INVENTION

The present invention relates to the field of electronic devices, and, more particularly, to filters for use in electronic circuits and related methods.

BACKGROUND OF THE INVENTION

Electromagnetic interference (EMI) or radio frequency (RF) interference from electrical devices, signal sources, etc., can interrupt or otherwise degrade the effective performance of certain telecommunication, computer, and other electrical/electronic equipment. As a result, filters are commonly used in numerous types of electronic circuits to allow signals of a desired frequency to pass along a signal path, for example, while reducing the propagation of other undesired frequencies.

One particular type of filter commonly used in electrical and electronic devices is the ferrite filter. Ferrite filters act as chokes which attenuate signals to a desired frequency range. One basic type of ferrite filter is the so-called ferrite "bead" which typically includes a single, "soft" ferrite material having a particular attenuation range that depends upon the type of ferrite used.

A somewhat more sophisticated ferrite shield is disclosed in U.S. Pat. No. 4,796,079 to Hettiger entitled "Chip Component Providing RF Suppression." The ferrite shield is formed by surrounding an electrical conductor with ferrite material and is made in the shape of a leadless chip to permit placement on a circuit board by chip insertion machines. In one embodiment, different shield elements are disposed along the lateral conductor signal path, where each shield element includes a different type of ferrite material having different impedance-frequency characteristics. Each shield element thus contributes to the overall impedance-frequency characteristics of the shield.

EMI can be a particular problem between about 800 MHz and about 15 GHz, for example. However, soft ferrites based on a spinel crystal structure are not traditionally used over 1 GHz or so because the ferromagnetic frequency response thereof decays rapidly in this frequency range. More particularly, most prior art surface mount EMI filters, such as those noted above, typically use soft ferrites which exhibit an impedance maximum below 2 GHz. While other types of ferrite are used in microwave frequencies in devices such as monolithic microwave integrated circuits (MMICs) and in elements of radar devices that operate in the low to high GHz frequency range, such devices may not readily lend themselves to relatively small-scale applications.

SUMMARY OF THE INVENTION

In view of the foregoing background, it is therefore an object of the present invention to provide a filter device and related methods which provide desirable impedance versus frequency characteristics over a relatively broad attenuation frequency band.

This and other objects, features, and advantages in accordance with the present invention are provided by a filter device which may include a plurality of ferrite filters laminated together in vertically stacked relation, where each ferrite filter may include a pair of ferrite layers laminated together in vertically stacked relation and a lateral conductor extending therebetween. The filter device may also include at least one vertical conductor connecting the lateral conductors together in series. Moreover, at least some of the ferrite filters may have different operating characteristics.

In particular, the different operating characteristics may be different impedance versus frequency characteristics to thereby broaden an attenuation frequency band of the filter device. For example, at least one of the ferrite layers may include iron deficient zinc ferrite to provide desired impedance characteristics at higher frequencies, and at least one other of the ferrite layers may include copper nickel zinc ferrite to provide desired impedance characteristics at lower frequencies. Specifically, the iron deficient zinc ferrite may include about 30–40 percent by weight ZnO and about 60–70 percent by weight $Fe_2O_3$.

The filter device may also include a first end conductor on a bottom one of the ferrite filters and connected to the lateral conductor thereof, and a second end conductor on a top one of the ferrite filters and connected to the lateral conductor thereof. Moreover, the first and second end conductors may be on a same side of the filter device. Additionally, the at least one vertical conductor may be at least one via extending between adjacent ferrite filters. Also, in some embodiments the lateral conductors may extend to opposing ends of their respective ferrite filters, in which case the at least one vertical conductor may be at least one vertical end conductor.

A method aspect of the invention is for making a filter device and may include arranging a plurality of ferrite layers in vertically stacked relation with a respective lateral conductor extending between adjacent pairs of ferrite layers. Furthermore, the lateral conductors may be connected in series using at least one vertical conductor, and the plurality of ferrite layers laminated together. This is done such that each adjacent pair of ferrite layers and respective lateral conductor defines a ferrite filter. Moreover, at least some of the ferrite filters may have different operating characteristics, as noted above.

DETAILED DESCRIPTION OF THE PREFERRED EMBODIMENTS

The present invention will now be described more fully hereinafter with reference to the accompanying drawings, in which preferred embodiments of the invention are shown.

This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
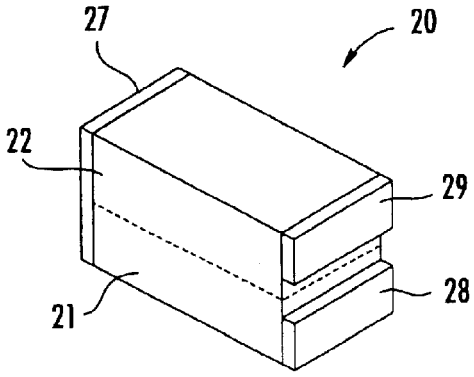
FIG. 1 is a perspective view of a filter device in accordance with the present invention.
Figure 2:
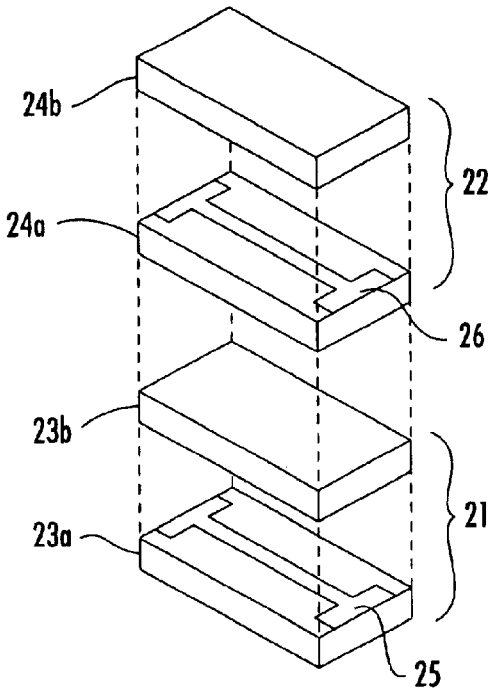
FIG. 2 is a perspective exploded view of the filter device of FIG. 1.
Figure 3:
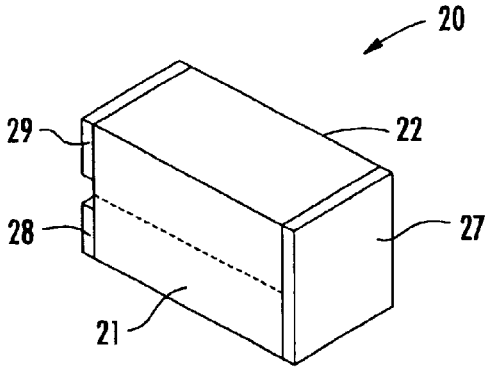
FIG. 3 is a perspective view of the filter device of FIG. 1 showing a back side thereof.

Referring initially to FIGS. 1–3, a filter device 20 in accordance with the present invention includes a bottom ferrite filter 21 and a top ferrite filter 22 laminated together in vertically stacked relation. More particularly, each ferrite filter 21, 22 includes a pair of ferrite layers 23*a*, 23*b* and 24*a*, 24*b* laminated together in vertically stacked relation and a lateral conductor 25, 26 extending therebetween, respectively.

The filter device 20 also includes a vertical end conductor 27 connecting the lateral conductors 25, 26 together in series. That is, as may be seen in FIG. 2, the lateral conductors 25, 26 extend to opposing ends of their respective filters 21, 22. Thus, by positioning the vertical end conductor 27 on one end of the filters 21, 22, the lateral conductors 25, 26 are connected in a series path. The lateral conductors 25, 26 may be formed by screen printing with a conductive ink, for example. More particularly, the vertical conductors 25, 26 and layers of ceramic slurry may be directly screen printed onto a plastic carrier to build up a complete three-dimensional unfired (i.e., "green") part one layer at a time.

Another approach is to use one or more layers of preformed ferrite tape for the ferrite layers 23*a*, 23*b*, 24*a*, 24*b* and print conductive patterns for their respective lateral conductors 25, 26 on (or both) of the adjoining surfaces of the tape layers. In particular, the lateral conductors may be formed by directly printing conductive paths of polymer-based ink including a large percentage of silver, or silver alloyed with a higher melting metal such as palladium, for example. Of course, other suitable conductive materials known to those of skill in the art may also be used. Furthermore, multiple layers of tape may have conductive paths printed on them for specific geometric paths for the conductor, as will be appreciated by those of skill in the art. The tape layers are then laminated, which forms the series conductive path between the lateral conductors 25, 26 and the vertical end conductor 27.

In both of the above noted cases, many individual parts may be printed simultaneously on the tape or substrate. The laminated array or the slurry printed array may be dried and then cut into desired individual parts and fired in a kiln using processing methods widely known to the ferrite industry. The vertical end conductor 27 may be similarly formed by applying a conductive paste on the appropriate side of the filter device 20 prior to laminating the layers together, as will be understood by those skilled in the art. Of course, other suitable conductors may also be used.

Additionally, the filter device 20 may also include a first end conductor 28 on the bottom ferrite filter 21 which is connected to the lateral conductor 25 thereof. Further, a second end conductor 29 is on the ferrite filter 22 and connected to the lateral conductor 26 thereof. The first and second end conductors 28, 29 advantageously provide input and output terminals for connecting the filter device 20 with other circuit components, as will be appreciated by those of skill in the art.

The first and second end conductors may similarly be formed using conductive paste, as with the vertical end conductor 27, and all of these end conductors may also be plated following lamination, if desired. In the illustrated example, the first and second end conductors 28, 29 are on a same side of the filter device, but it will be appreciated that in other embodiments one or both of the first and second end conductors could be located on a different side of the filter device 20 to provide various connection configurations. In such case, the lateral conductors 25, 26 may be formed to terminate at the appropriate side of the filter device 20, as will be understood by those skilled in the art.

In accordance with the invention, the ferrite filters 21, 22 preferably have different operating characteristics, i.e., impedance versus frequency characteristics to broaden an attenuation frequency band of the filter device 20. That is, when different ferrite materials are used in one or more of the layers 23*a*, 23*b*, 24*a*, 24*b* of the ferrite filters 21, 22, these filters exhibit different impedance versus frequency characteristics. Stated alternately, by using different type of ferrite materials in the filters 21, 22, the resonance points or insertion loss nulls of these filters will be different, which when combined provides for a wider attenuation frequency band.

In particular, one important aspect in accordance with the present invention is that zinc ferrite, a material which with proper adjustments of the zinc content can be made to have nearly paramagnetic properties at or about operating temperatures of the device to adjust its resonance point well into the microwave range. Accordingly, by using zinc ferrite in one of the layers 23*a*, 23*b*, 24*a*, 24*b*, one or both of the ferrite filters 21, 22 advantageously provide desired impedance characteristics at higher frequencies than in typical soft ferrite filters.

Figure 4:
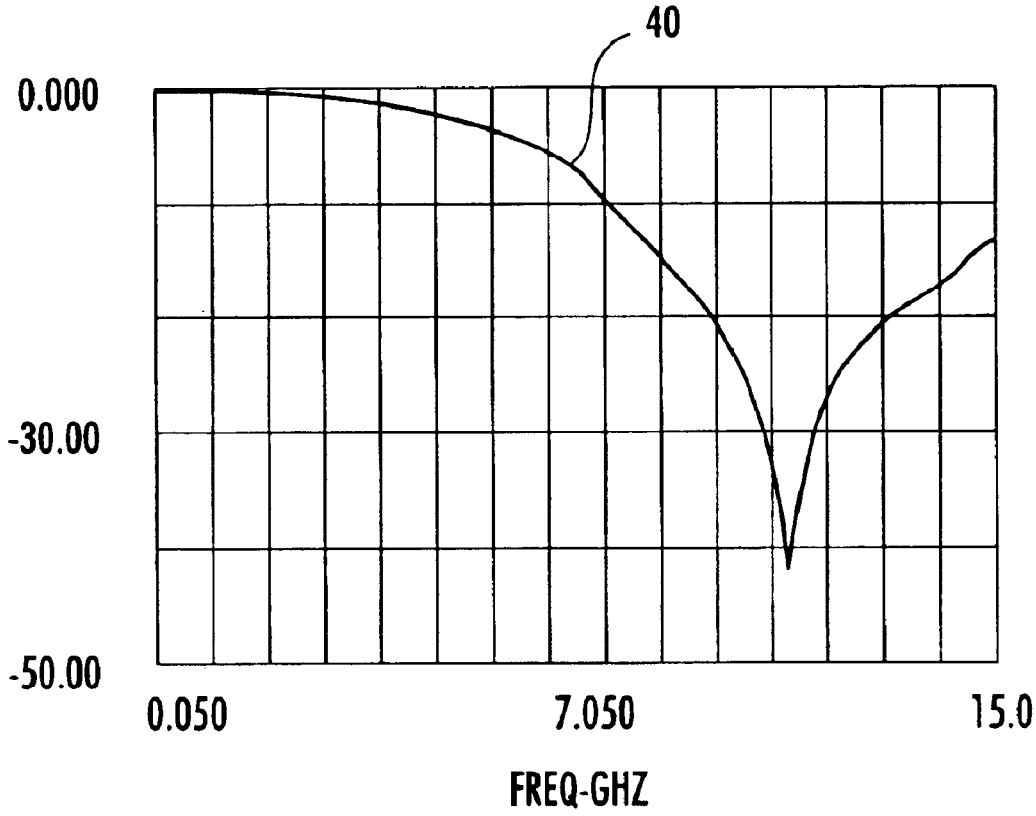
FIG. 4 is a graph illustrating impedance versus frequency characteristics of the high frequency ferrite filter of the filter device of FIG. 1.

Specifically, it has been found that a somewhat iron deficient zinc ferrite is well suited for this purpose, which may include about 30–40 percent by weight ZnO and about 60–70 percent by weight $Fe_2O_3$, for example, though other percentages may also be used. It will be appreciated that the amount of ZnO used will affect both the resonance point of the filter device as well as the magnetic characteristics thereof. The impedance versus frequency characteristics for a single ferrite filter in which both ferrite layers include such iron deficient zinc ferrite are shown in the plot 40 of the graph of FIG. 4. As may be seen, the resonance point of this filter is between 11 and 12 GHz, well beyond the attenuation range possible with typical prior art ferrite filters.

Regarding the advantageous high frequency attenuation, or insertion loss, of the iron deficient zinc ferrite material, applicants theorize, without wishing to be bound thereto, that this insertion loss is caused by a destructive interference of propagation and internally reflected electromagnetic waves in the ferrite filter, or as surface waves operating on the "skin" or near surface volume of the ferrite filter which may be adjacent to the conductor path 25, 26, 69, 70 or 71. With this in mind, prototype ferrite filters made as described above with iron deficient zinc ferrite which have insertion losses in the 10–12 GHz and 15 GHz range were constructed and analyzed, and some general design considerations may be made based upon the operational characteristics thereof.

First, it will be appreciated by those of skill in the art that the wavelength in a medium in which an electromagnetic wave is propagating is related to the permeability and permittivity of the medium. Accordingly, the insertion loss null of a given filter will depend on the permeability and permittivity of the ferrite materials used. Moreover, the insertion loss null will also be dependent on conductor length and part size, as will also be appreciated by those of skill in the art.

Thus, for a given application, it will be important to select an initial combination of ferrite materials, conductor lengths, and part sizes to achieve nulls near the desired frequencies. Other ferrite materials with slight changes in permeability and/or permittivity may then be used to further refine the position of these nulls since the wavelength will change. Performance curves may then be constructed for candidate ferrites and the position of a null may be selected therefrom, as will be understood by those skilled in the art.

If one of the ferrite filters 21, 22 includes the above noted iron deficient zinc ferrite material, one or more layers of the other ferrite filter may include a ferrite material with impedance versus frequency characteristics which are complementary to those of the iron deficient zinc ferrite filter (e.g., lower than) to thus provide a broadened attenuation frequency range. By way of example, the other ferrite material may include copper nickel zinc ferrite, which provides desired impedance characteristics at lower frequencies.

Figure 5:
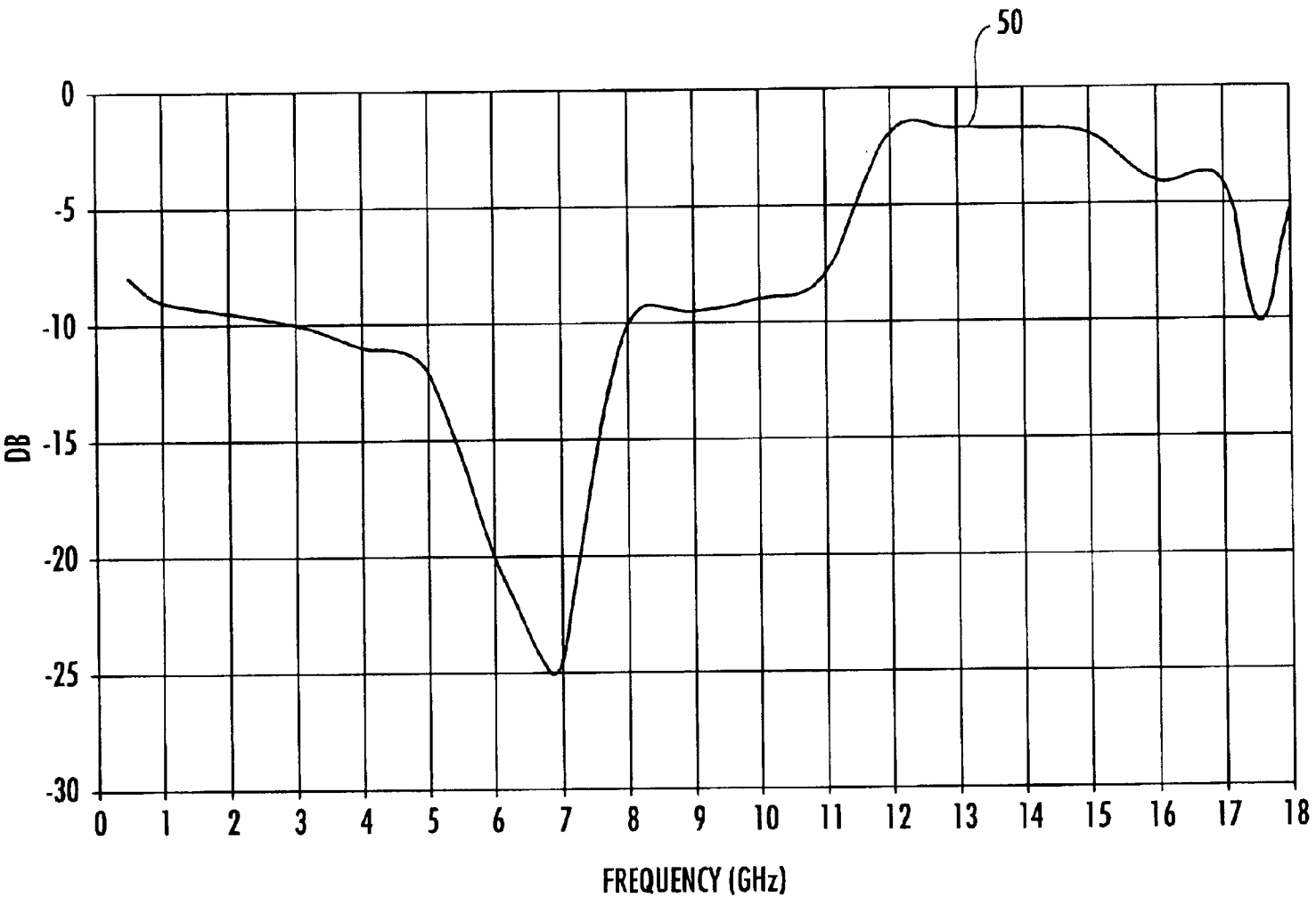
FIG. 5 is a graph illustrating the combined impedance versus frequency characteristics of both the high and low frequency ferrite filters of the filter device of FIG. 1.

The impedance versus frequency characteristics for a filter device 20 in which the layers 23*a*, 23*b* or 24*a*, 24*b* of one filter device 21, 22 include the above described iron deficient zinc ferrite and the layers of the other filter device include copper nickel zinc ferrite are shown in the plot 50 of the graph of FIG. 5. As may be seen, the filter device 20 has nulls between 6 and 7 GHz and between 17 and 18 GHz. Of course, those of skill in the art will appreciate that various types, amounts, and/or compositions of ferrite materials may be used to provide desired impedance versus frequency characteristics in different applications, as noted above. Specific examples including process details for making various iron deficient zinc ferrite and copper nickel zinc ferrite materials are provided below.

Figure 6:
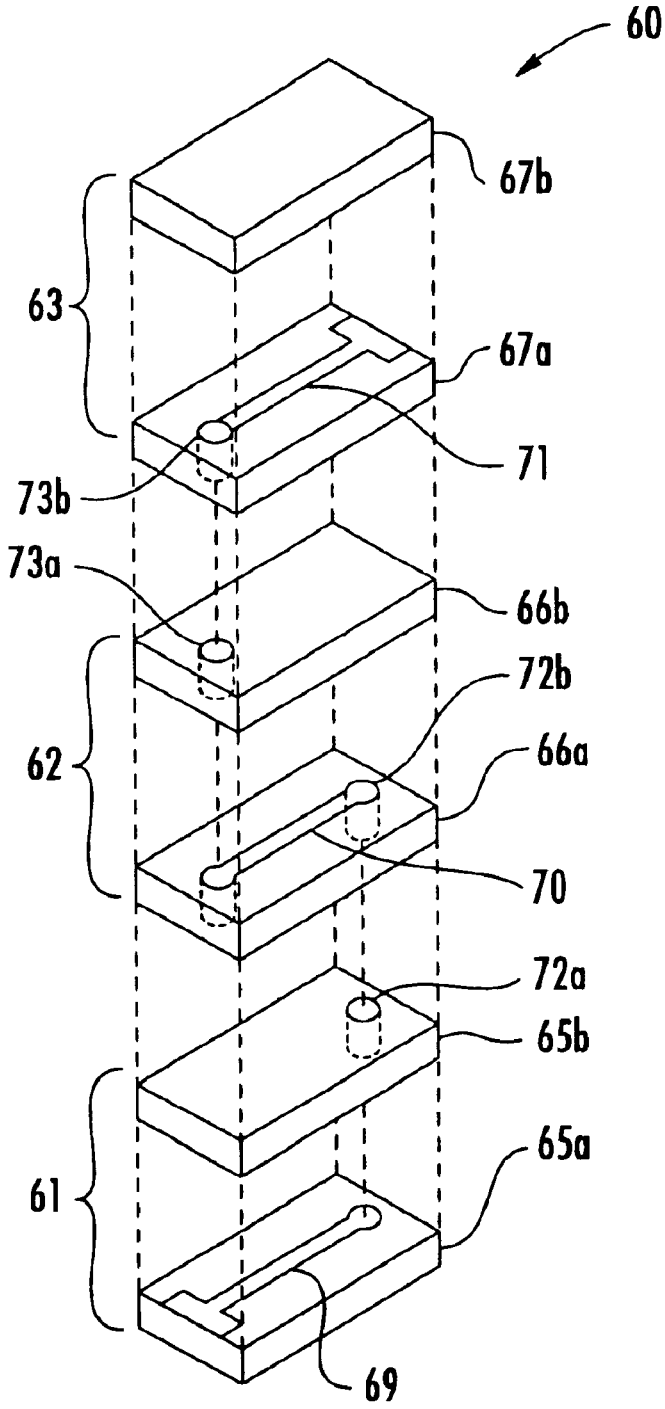
FIG. 6 is a perspective view illustrating the assembly of an alternate embodiment of the filter device in accordance with the present invention.

An alternate embodiment of a filter device 60 in accordance with the present invention is now described with reference to FIG. 6. The filter device 60 includes three ferrite filters 61, 62, 63, each of which includes respective pairs of ferrite layers 65*a* and 65*b*, 66*a* and 66*b*, and 67*a* and 67*b* and lateral conductors 69–71 extending therebetween. Moreover, rather than using vertical end conductors 27 to provide the series connection between the vertical end conductors as in the filter device 20 noted above, vias 72, 73 are used for this purpose. That is, the via 72 (illustratively shown in lower and upper portions 72*a*, 72*b* in the unassembled view of FIG. 6) extends between the ferrite filters 61, 62 to connect the lateral conductors 69, 70 in series. Similarly, the via 73 (illustratively shown as lower and upper portions 73*a*, 73*b*) extend between the filters 62, 63 to connect the lateral conductors 70, 71 in series.

The vias 72, 73 may be formed using known fabrication techniques, as will be understood by those of skill in the art. One approach is to form holes in the appropriate locations of the green layers 65*b*, 66*a*, 66*b*, and 67*a* and then fill these holes with the conductive ink used for screen printing the lateral conductors 69–71. Of course, the filter 60 may also include end conductors similar to the first and second end conductors 28, 29 described above to provide connection with other circuit elements.

The ferrite filters 61–63 may all include different ferrite materials to provide different impedance versus frequency characteristics, or two or more of the ferrite filters may include the same material. By way of example, the filters 61 and 63 may include the above noted iron deficient zinc ferrite material, while the filter 62 may include the copper nickel zinc ferrite material. Other zinc ferrites and conductor material types, arrangements, etc. are also possible and are contemplated by the present invention, as will be appreciated by those skilled in the art.

A method aspect of the invention for making the above described filter device 20 includes arranging the ferrite layers 23*a*, 23*b*, 24*a*, 24*b* in vertically stacked relation with the respective lateral conductors 25, 26 extending between adjacent pairs of the ferrite layers, as previously noted above. As noted above, the ferrite layers may be ferrite tape layers cut to a predetermined size, and the lateral conductors 25, 26 may be screen printed thereon. Furthermore, conductive paste may be applied to the appropriate locations on the ends of the ferrite filters 21, 22 to form the vertical end conductor 27 and first and second end conductors 28, 29. The ferrite layers 23*a*, 23*b*, 24*a*, 24*b* may then be laminated together, and the laminated assembly sintered to form the filter device 20.

Of course, it will appreciated that various other steps may be included in place of, or in addition to, those briefly described above. For example, openings may be formed in the various ferrite layers and conductive paste placed therein to make the conductive vias 72, 73, as in the embodiment illustrated in FIG. 6. Other method aspects of the invention will also be appreciated based upon the foregoing description, and in view of the exemplary zinc ferrite material formation process details provided below.

EXAMPLE 1

Iron Deficient Zinc Ferrite Material Made from Raw Materials 1.0 Product Formulation and Mixing Requirements for ZF10 Calcine.

1.1 Mix the following materials using an Elrich model R-07 (or other suitable mixer):

| Raw Material | Supplier | Grade | Weight |
|---|---|---|---|
| Iron Oxide | Thyssen Krupp Stahl | Premium Ground Thyssen | 110.2 ± 1.0 lbs. |
| Zinc Oxide | Zochem | Zoco 103 | 81.9 ± 0.6 lbs. |

1.2 Pull sample for x-ray on the first two mixes of each lot to ensure proper mixture, consistency, etc. Mixing times are as follows:

| Step | Time/Quantity | Comment |
|---|---|---|
| 1. Pre-mix on high speed: | ~1 minute | |
| 2. Add water: | ~3.5 gallons | Adjust as necessary to achieve pellet integrity. |
| 3. Mix on high speed: | ~6 minutes | Adjust as necessary to achieve pellet integrity. |
| 4. Mix on low speed: | ~4 minutes | Adjust as necessary to achieve pellet integrity. |
| 5. Pan on: | As needed to achieve ~0.1–.02" pellet | |

2.0 Drying.

2.1 Dry in suitable dryers under the following condition:

| | |
|---|---|
| Temp: | 425° F. |
| Time: | 24 hours (minimum) |

2.2 Another option is to allow the material to dry next to a kiln, for example.

3.0 Calcining.

3.1 Perform Calcining using a rotary calciner as follows:

| | Tolerance | Test Frequency |
|---|---|---|
| Bulk Density: (g/cc) : | 1.50 g/cc min | 1 time per barrel |
| Temp. (Zone 1): | *1050 ±5 ° C. | Every two hours |
| Temp. (Zone 2): | *1050 ±5 ° C. | Every two hours |
| Temp. (Zone 3): | *1050 ±5 ° C. | Every two hours |
| Feed Set: | TBD | Every two hours |
| Feed Rate (Exit): | 25–35 lbs/hr | Every two hours |
| RPM (tube) : | 2 | Once per shift |
| Angle | 2° | Once per shift |
| Draft/Baghouse (inches water column) | TBD | Every two hours |
| EMU/g | *<3 | Every two hours |

*Critical Parameter

EXAMPLE 2

Iron Deficient Zinc Ferrite Made from Pre-Processed Zinc Ferrite Material 1.0 Lot Make-Up ZF-10 Calcine—99%

$Bi_2O_3$—1%

2.0 Mill with Attritor (Model S100)

2.1 Rinse attritor thoroughly prior to use.

2.2 Calcine Charge:

| | |
|---|---|
| ZF-10 Calcine Wt. | 800 lbs |
| $Bi_2O_3$: | 8 lbs |
| Water: | 33 gallons |
| Colloid 102: | 1000 cc |
| Foamblast 338 (RossChem): | 80 cc |

2.3 Up to 4 gallons of water may be added to aid unloading (as pulp density permits). Also, 500 cc of colloid may also be added to each mill to aid in unloading.

| | |
|---|---|
| Mill Time: | As necessary to achieve BET target |
| BET Target: | *2.15–2.35 $m^2/g$ |
| Pulp Density: | 2450–2500 |

*Critical Parameter 2.4 Check pH on each attritor mill when the BET target has been achieved, and record results on attritor mill log.

3.0 Slurry Screening.

3.1 Screen all slurry transferred to the tank(s) with Sweco 30" or other suitable screener.

Screen size: 150 MG (with backing wire)

4.0 Slurry Tanks.

4.1 Clean all slurry tanks thoroughly prior to use. All slurry transferred to tanks should have accurate weight and pulp density measurements.

4.2 Perform x-ray analysis on slurry samples. BET measurements are preferably performed on one sample (for reference purposes).

5.0 Tank Adjustments.

5.1 Raw Materials (tank adjustments):

| | |
|---|---|
| Iron Oxide (Fe2O3) | Premium Ground Thyssen (see 1.1 above) |
| Zinc Oxide (ZnO) | Zoco 103 (Zochem) |

5.2 Water Addition: total adjustment lbs×0.04=gallons of water.

5.3 Perform pH check on "dry as is" slurry (before binder addition).

6.0 Binder Addition:

| | Vendor | Part Number |
|---|---|---|
| Binder: | Southern Chemicals | SCT-227 |
| Plasticizer: | Southern Chemicals | SCT-471 |

6.1 Mix binder in a clean PVA tank or a clean barrel using a portable mixer.

6.2 Add Colloid 102 to tank while the binder/plasticizer is mixing (at least 30 minutes before the binder is added). Colloid addition is calculated by multiplying the calculated tank weight of the calcine mills by 0.50, which is rounded to the nearest 50 cc.

6.3 Binder/plasticizer should be added to the PVA tank or barrel in the specified amount.

6.4 Agitate binder/plasticizer for 30 minutes before unloading into the slurry tank.

6.5 Agitate the slurry in the tank for 1 hour after the binder has been added.

6.6 Record binder/plasticizer weights, lot # and barrel number on attritor log.

7.0 Spray Drying.

7.1 Clean spray dryer and cyclone thoroughly prior to use.

7.2 Add 200 cc of Foamblast before spray drying.

7.1 Material conditions, dryer conditions and in process testing.

| Parameter | Value | Test Frequency |
|---|---|---|
| Pump Pressure: | 800–950 | Each Barrel |
| Pulp Density (g/1000 cc): | 2100–2200 | Each Barrel |
| Product Temperature (C): | *95–105 | Each Barrel |

-continued

| Parameter | Value | Test Frequency |
|---|---|---|
| Orifice: | 0.047–0.051" (0.049° nom.) | Every Lot |
| Swirl Chamber: | SG | Every Lot |
| Draft/Cyclone (#2 dryer): | 0.1–1.2 | Each Barrel |
| Draft/Baghouse: | 6.0 Max | Each Barrel |
| Inlet Temperature (F): | *500–525 | Each Barrel |
| Outlet Temperature (F): | 230–280 | Each Barrel |
| pH (Slurry): | TBD | Each Barrel |
| Bulk Density: g/cc: | 0.75–1.00 | Each Barrel |
| 60 Mesh Sleeve (5 minute tap): | 3–10% | Each Barrel |

7.2 Screen slurry via slurry filter (mesh size=20 MG)

8.0 Screening.

8.1 Exemplary screener—Rotex (Model 12A)

Top Screen: HC-7 212/70

Bottom Screen: None 8.2 Coarse material should be re-screened 2 times.

8.3 Unload product into barrels and check samples for moisture. If product passes moisture test, package in bulk bags per print specifications.

8.4 If product fails moisture test, place barrels in dryers for two hours. Set temperature to 150° F. The operator should use his best judgment to determine necessary drying time.

8.5 Final analysis may be performed on dried samples.

EXAMPLE 3

Copper Nickel Zinc Ferrite Material Made from Raw Materials 1.0 Dry Mix Composition (Raw Pellets).

1.1 Normalize elements below to composition specified.

| | Nominal EXZN FE-235 final |
|---|---|
| MnO: | 0.15 wt. % |
| $Fe_2O_3$ | 64.91 wt. % |
| NiO | 0.11 wt. % |
| CuO | 0.02 wt. % |
| ZnO | 34.81 wt. % |
| $Bi_2O_3$ | 0.00% |
| $SiO_2$ | 0.00% |

2.0 Final Composition Adjustment.

2.1 Maximum tank adjustment percentage on final composition adjustment: 3.00%.

2.2 Re-normalize elements below to composition specified.

| | Nominal EXZN FE-235 final |
|---|---|
| MnO: | 0.15 wt. % |
| $Fe_2O_3$ | 64.91 wt. % |

-continued

| | Nominal EXZN FE-235 final |
|---|---|
| NiO | 0.11 wt. % |
| CuO | 0.02 wt. % |
| ZnO | 34.81 wt. % |
| $Bi_2O_3$ | 0.00% |
| $SiO_2$ | 0.00% |

3.0 Water Addition.

3.1 Total adjustment (lb.)×0.04=gallons of water.

4.0 Mill Time.

4.1 Additions<1.0%=15 minutes.

4.2 Additions>1.0%=30 minutes.

5.0 BET Measurement (#2 Quantasorb).

5.1 Calcine Mills: 2.15–2.36 $m^2/g$ (once Coulter reaches 2.80 microns (ferrite)).

6.0 Reference Part Print for Final Product Specifications.

It will therefore be appreciated that filter devices in accordance with the invention which provide attenuation well above 2 GHz may be constructed in a convenient leadless chip that may easily be used in circuit applications. In particular, it is anticipated that device footprint sizes as low as 0.25 inches square by 0.25 inches in height or smaller may be achieved in accordance with the present invention.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A filter device comprising:

a plurality of ferrite filters laminated together in vertically stacked relation, each ferrite filter comprising a pair of ferrite layers laminated together in vertically stacked relation and a lateral conductor extending therebetween, and at least one of said ferrite layers comprising iron deficient zinc ferrite; and at least one vertical conductor connecting said lateral conductors together in series;

at least some of said ferrite filters having different operating characteristics.

2. The filter device of claim 1 wherein the different operating characteristics comprise different impedance versus frequency characteristics to thereby broaden an attenuation frequency band of the filter device.

3. The filter device of claim 1 further comprising a first end conductor on a bottom one of said ferrite filters and connected to said lateral conductor thereof, and a second end conductor on a top one of said ferrite filters and connected to said lateral conductor thereof.

4. The filter device of claim 3 wherein said first and second end conductors are on a same side of the filter device.

5. The filter device of claim 1 wherein said at least one vertical conductor comprises at least one via extending between adjacent ferrite filters.

6. The filter device of claim 1 wherein said lateral conductors extend to opposing ends of their respective ferrite filters; and wherein said at least one vertical conductor comprises at least one vertical end conductor.

7. The filter device of claim 1 wherein the iron deficient zinc ferrite comprises about 30–40 percent by weight ZnO and about 60–70 percent by weight $Fe_2O_3$.

8. The filter device of claim 1 wherein at least one of said ferrite layers comprises copper nickel zinc ferrite.

9. A filter device comprising:

a plurality of ferrite filters laminated together in vertically stacked relation, each ferrite filter comprising a pair of ferrite layers laminated together in vertically stacked relation and a lateral conductor extending therebetween; and at least one vertical conductor connecting said lateral conductors together in series;

at least one of said ferrite filters comprising iron deficient zinc ferrite, and at least one other of said ferrite filters comprising copper nickel zinc ferrite.

10. The filter device of claim 9 wherein said at least one ferrite filter comprising iron deficient zinc ferrite and said at least one other ferrite filter comprising copper nickel zinc ferrite have different impedance versus frequency characteristics to thereby broaden an attenuation frequency band of the filter device.

11. The filter device of claim 9 further comprising a first end conductor on a bottom one of said ferrite filters and connected to said lateral conductor thereof, and a second end conductor on a top one of said ferrite filters and connected to said lateral conductor thereof.

12. The filter device of claim 11 wherein said first and second end conductors are on a same side of the filter device.

13. The filter device of claim 9 wherein said at least one vertical conductor comprises at least one via extending between adjacent ferrite filters.

14. The filter device of claim 9 wherein said lateral conductors extend to opposing ends of their respective ferrite filters; and wherein said at least one vertical conductor comprises at least one vertical end conductor.

15. The filter device of claim 9 wherein the iron deficient zinc ferrite comprises about 30–40 percent by weight ZnO and about 60–70 percent by weight $Fe_2O_3$.

16. A method for making a filter device comprising:

arranging a plurality of ferrite layers in vertically stacked relation with a respective lateral conductor extending between adjacent pairs of ferrite layers, at least one of the ferrite layers comprising iron deficient zinc ferrite;

connecting the lateral conductors in series using at least one vertical conductor; and laminating the plurality of ferrite layers together such that each adjacent pair of ferrite layers and respective lateral conductor defines a ferrite filter, and at least some of the ferrite filters having different operating characteristics.

17. The method of claim 16 wherein the different operating characteristics comprise different impedance versus frequency characteristics to thereby broaden an attenuation frequency band of the filter device.

18. The method of claim 16 wherein arranging comprises arranging a plurality of ferrite tape layers in vertically stacked relation.

19. The method of claim 16 wherein each lateral conductor is screen printed on one of the adjoining faces of its respective ferrite layers.

20. The method of claim 16 further comprising connecting a first end conductor on a bottom one of the ferrite filters and connected to the lateral conductor thereof, and connecting a second end conductor on a top one of the ferrite filters and connected to the lateral conductor thereof.

21. The method of claim 20 wherein the first and second end conductors are connected on a same side of the filter device.

22. The method of claim 16 wherein the at least one vertical conductor comprises at least one via extending between adjacent ferrite filters.

23. The method of claim 16 wherein the lateral conductors extend to opposing ends of their respective ferrite filters; and wherein the at least one vertical conductor comprises at least one vertical end conductor.

24. The method of claim 16 wherein the iron deficient zinc ferrite comprises about 30–40 percent by weight ZnO and about 60–70 percent by weight $Fe_2O_3$.

25. The method of claim 16 wherein at least one of the ferrite layers comprises copper nickel zinc ferrite.

26. A filter device comprising:

a plurality of ferrite filters laminated together in vertically stacked relation, each ferrite filter comprising a pair of ferrite layers laminated together in vertically stacked relation and a lateral conductor extending therebetween, and at least one of said ferrite layers comprising copper nickel zinc ferrite; and at least one vertical conductor connecting said lateral conductors together in series;

at least some of said ferrite filters having different operating characteristics.

27. The filter device of claim 26 wherein the different operating characteristics comprise different impedance versus frequency characteristics to thereby broaden an attenuation frequency band of the filter device.

28. The filter device of claim 26 further comprising a first end conductor on a bottom one of said ferrite filters and connected to said lateral conductor thereof, and a second end conductor on a top one of said ferrite filters and connected to said lateral conductor thereof.

29. A method for making a filter device comprising:

arranging a plurality of ferrite layers in vertically stacked relation with a respective lateral conductor extending between adjacent pairs of ferrite layers, at least one of the ferrite layers comprising copper nickel zinc ferrite;

connecting the lateral conductors in series using at least one vertical conductor; and laminating the plurality of ferrite layers together such that each adjacent pair of ferrite layers and respective lateral conductor defines a ferrite filter, and at least some of the ferrite filters having different operating characteristics.

30. The method of claim 29 wherein the different operating characteristics comprise different impedance versus frequency characteristics to thereby broaden an attenuation frequency band of the filter device.

31. The method of claim 29 further comprising connecting a first end conductor on a bottom one of the ferrite filters and connected to the lateral conductor thereof, and connecting a second end conductor on a top one of the ferrite filters and connected to the lateral conductor thereof.

* * * * *